US009187879B2

(12) United States Patent
Suk

(10) Patent No.: US 9,187,879 B2
(45) Date of Patent: Nov. 17, 2015

(54) METHOD FOR CONTROLLING OPERATION OF DUMP FOR CONSTRUCTION MACHINERY

(75) Inventor: Ok-Jin Suk, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 0 days.

(21) Appl. No.: 14/369,908

(22) PCT Filed: Jan. 2, 2012

(86) PCT No.: PCT/KR2012/000017
§ 371 (c)(1),
(2), (4) Date: Jun. 30, 2014

(87) PCT Pub. No.: WO2013/103157
PCT Pub. Date: Jul. 11, 2013

(65) Prior Publication Data

US 2014/0343805 A1 Nov. 20, 2014

(51) Int. Cl.

| | |
|---|---|
| ***G06F 17/00*** | (2006.01) |
| ***G06F 19/00*** | (2011.01) |
| ***E02F 9/22*** | (2006.01) |
| ***E02F 9/24*** | (2006.01) |
| ***E02F 3/43*** | (2006.01) |
| ***E02F 9/20*** | (2006.01) |

(52) U.S. Cl.
CPC ..... *E02F 9/2285* (2013.01); *E02F 3/434* (2013.01); *E02F 3/439* (2013.01); *E02F 9/2012* (2013.01); *E02F 9/2037* (2013.01); *E02F 9/24* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,377,043 | A | 3/1983 | Inui et al. | |
| 6,185,493 | B1 * | 2/2001 | Skinner et al. | 701/50 |
| 2009/0218112 | A1 * | 9/2009 | Mintah et al. | 172/1 |
| 2010/0254793 | A1 * | 10/2010 | Trifunovic | 414/700 |
| 2011/0301817 | A1 * | 12/2011 | Hobenshield et al. | 701/50 |
| 2012/0239263 | A1 * | 9/2012 | Choi | 701/50 |
| 2013/0125537 | A1 * | 5/2013 | Kim | 60/327 |
| 2013/0269332 | A1 | 10/2013 | Suk et al. | |
| 2014/0158235 | A1 | 6/2014 | Suk et al. | |

FOREIGN PATENT DOCUMENTS

| | | | |
|---|---|---|---|
| EP | 1323870 | A1 | 7/2003 |
| JP | 62-214406 | A | 9/1987 |
| JP | 07-259117 | A | 10/1995 |
| JP | 10-008490 | A | 1/1998 |
| JP | 10-018339 | A | 1/1998 |

OTHER PUBLICATIONS

Declaration of Non-Establishment of International Search Report (in Korean and English) and Written Opinion (in Korean) for PCT/KR2012/000017, mailed Sep. 25, 2012; ISA/KR.
International Preliminary Report on Patentability (Chapter II of the Patent Cooperation Treaty) with Annexes (in Korean) for PCT/KR2012/000017, dated Apr. 9, 2014; IPEA/KR.

* cited by examiner

*Primary Examiner* — Thomas Tarcza
*Assistant Examiner* — Edward Pipala
(74) *Attorney, Agent, or Firm* — Harness, Dickey & Pierce, P.L.C.

(57) ABSTRACT

A method for controlling dump driving for a construction machine is disclosed, which can improve operability through simultaneous operation of boom-up and swing according to an operation of a swing joystick during a dumping work.

10 Claims, 3 Drawing Sheets

METHOD FOR CONTROLLING OPERATION OF DUMP FOR CONSTRUCTION MACHINERY

CROSS-REFERENCE TO RELATED APPLICATIONS

This application is a U.S. National Stage Application of International Application No. PCT/KR2012/000017 filed on Jan. 2, 2012, and published in Korean as WO 2013/103157 A2 on Jul. 11, 2013. The entire disclosure of the above application is incorporated herein by reference.

TECHNICAL FIELD

The present invention relates to a method for controlling dump driving for a construction machine. More particularly, the present invention relates to a method for controlling dump driving for a construction machine, which can improve operability through simultaneous operation of boom-up and swing according to an operation of a swing joystick during a dumping work.

BACKGROUND ART

In general, in the case of performing a dumping work that is one of excavating works of an excavator, an upper swing structure may swing up to a dumping position to load a loading container of a dump truck with excavated earth and sand after a digging work is completed. That is, joysticks of swing and boom-up of the upper swing structure may be operated almost simultaneously to adjust a swing angle and a boom-up height to reach a dumping position.

In this case, since an operator simultaneously determines the dumping position and dumping height while operating the swing joystick with one hand and operating the boom-up joystick with the other hand, it is required for the operator to pay much attention thereto. In other words, the operator should pay careful attention in operating the swing joystick to make the excavated earth and sand reach the dumping position and simultaneously operating the boom-up joystick to match the dumping height to the loading container.

As an example, if the dumping position gets out of an operator's viewing angle, the operator may accurately match the dumping position only in the case where the dumping position comes into the operator's viewing angle through performing of somewhat swing driving.

As described above, in order to perform the above-described works to match the swing angle and the boom-up height during the dumping work, operator's concentration is required in separately operating the swing joystick and the boom joystick while confirming the dumping position, and thus operator's fatigue is increased.

Further, if the dumping height does not match the loading container during the dumping work, it is required for the operator to match the dumping height again through the operation of the boom-up joystick, and this may cause the increase of the work time to deteriorate the work efficiency.

DISCLOSURE

Technical Problem

Therefore, an embodiment of the present invention is related to a method for controlling dump driving for a construction machine, which can provide operational convenience to an operator through simultaneous operation of boom-up and swing according to an operation of a swing joystick during a dumping work, and can reduce operator's fatigue through non-requiring of high concentration during the joystick operation.

Further, an embodiment of the present invention is related to a method for controlling dump driving for a construction machine, which can enable an operator to accurately set a desired boom-up height, and thus can proceed with a dumping work accurately and rapidly to improve workability.

Technical Solution

In accordance with an aspect of the present invention, a method for controlling dump driving for a construction machine including a lower driving structure, an upper swing structure mounted on the lower driving structure to swing according to an operation of a swing joystick, a cab mounted on the upper swing structure, and an attachment including a boom fixed to a front end of the upper swing structure to be driven according to an operation of an attachment joystick, includes a first step of setting a semi-auto dumping mode according to an operation of an input device; a second step of setting a swing direction of the upper swing structure for a dumping work and a boom-up dumping height; a third step of determining the swing direction of the upper swing structure through determination of whether operation signal values, which are input to a controller to correspond to an operation amount in the case where the swing joystick is operated in left and right directions, are larger than predetermined values; a fourth step of controlling a corresponding swing valve according to the operation signal value of the swing joystick in the swing direction determined in the third step and driving boom-up according to the operation signal value obtained through the operation of the swing joystick; a fifth step of stopping the boom-up driving when the boom-up height reaches a predetermined dumping height, and making the upper swing structure swing to a dumping position according to the operation signal value of the swing joystick; a sixth step of driving the corresponding swing valve according to the operation signal value of the swing joystick so that the upper swing structure swings in an opposite direction to the swing direction of the upper swing structure; and a seventh step of stopping the boom-up and the swing driving if the operation signal value of the swing joystick is not input.

Preferably, a monitor that is installed in the cab may be used as the input device in the first step.

The boom-up dumping height in the second step may be set and changed through a monitor that is installed in the cab.

The boom-up dumping height in the second step may be set and changed through an operation button that is installed in the cab.

An operation button that is installed in the cab may be used as the input device in the first step.

The fourth step may operate to receive feedback of a boom position and to perform boom-up to a predetermined dumping position even if the boom-up joystick for the boom-up driving is not operated in the fourth step.

If it is required that a boom cylinder for driving the attachment in order to execute a semi-auto dumping work is constantly positioned in a predetermined position, the boom cylinder position may be set and changed according to an operator's request, and may be maintained regardless of the operation of other attachments.

If a semi-auto dumping mode is set and the swing and the boom-up are simultaneously operated through the operation of the swing joystick in a semi-auto swing direction, a boom-up preferential function may be displayed during the operation of the boom-up joystick, and relatively higher control signal pressure than control signal pressure that is input to a boom-up solenoid valve through the operation of the swing joystick may be input according to an operation amount of the boom-up joystick.

If a semi-auto dumping mode is set and the swing and the boom-up are simultaneously operated through the operation of the swing joystick in a semi-auto swing direction, an input of control signal pressure to a boom-up solenoid valve may be cut off even if the boom-up joystick is operated.

Advantageous Effect

The method for controlling dump driving for a construction machine according to an embodiment of the present invention as described above has the following advantages.

The operational convenience can be provided to the operator through the simultaneous operation of boom-up and swing according to the operation of the swing joystick during the dumping work that is one of the excavating works, and the operator's fatigue can be reduced through non-requiring of the high concentration during the joystick operation.

Further, since the operator can accurately set the desired boom-up height during the dumping work and the swing can easily reach the dumping position only through the operation of the swing joystick after the setting, the dumping work can be done accurately and rapidly to improve workability.

BRIEF DESCRIPTION OF THE DRAWINGS

The above objects, other features and advantages of the present invention will become more apparent by describing the preferred embodiments thereof with reference to the accompanying drawings, in which.

BEST MODE

Hereinafter, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 1:
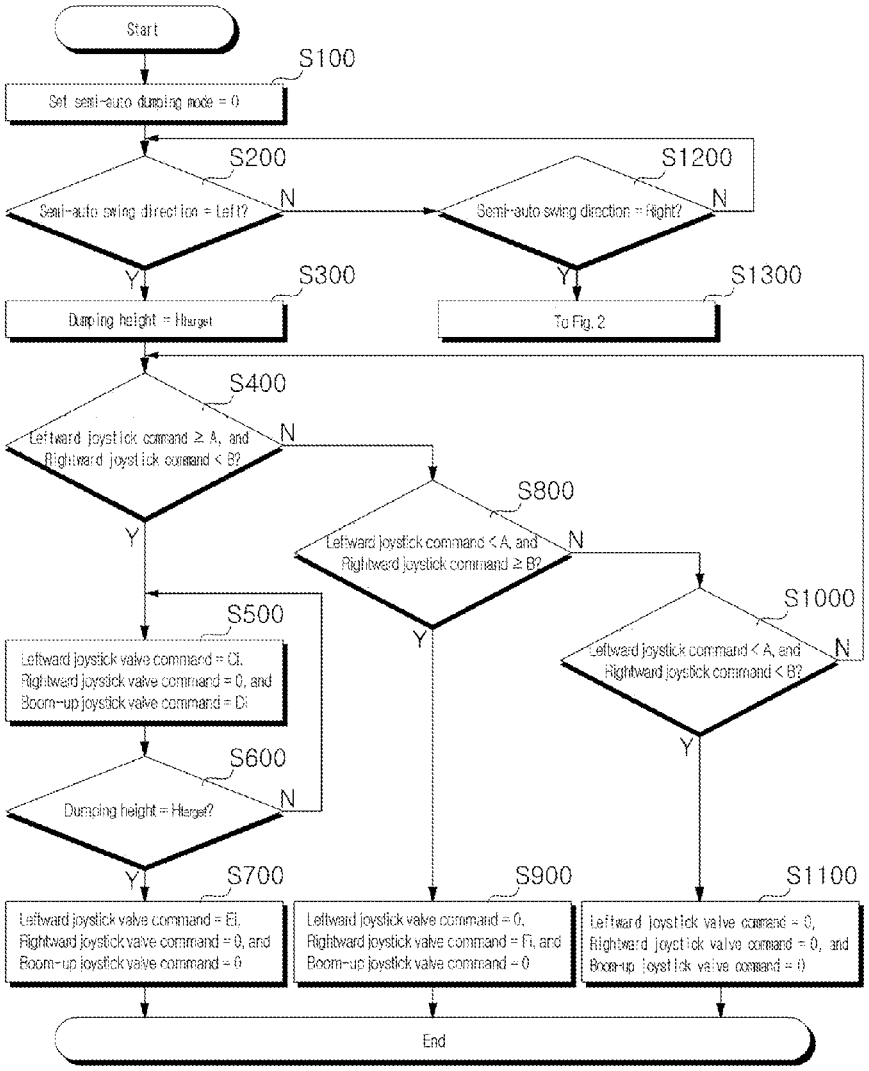
FIG. 1 is a flowchart illustrating a dumping work process through making an upper swing structure swing in a left direction in a method for controlling dump driving for a construction machine according to an embodiment of the present invention.
Figure 2:
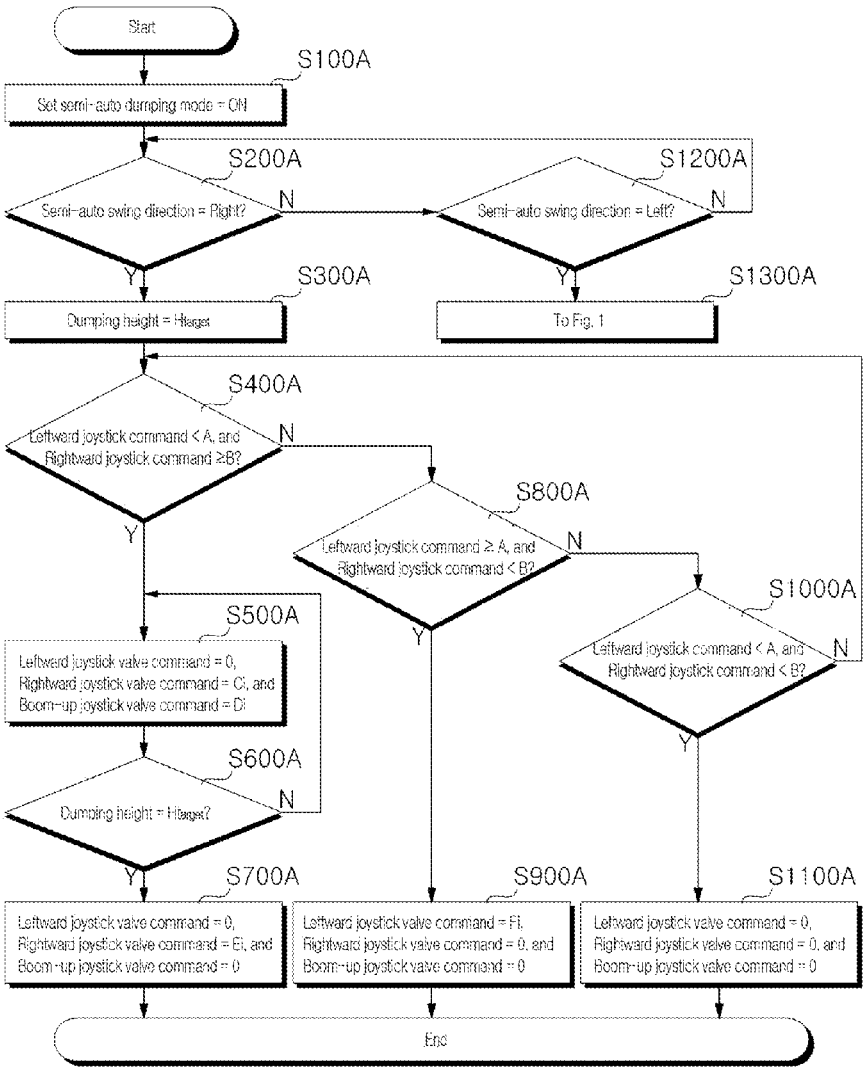
FIG. 2 is a flowchart illustrating a dumping work process through making an upper swing structure swing in a right direction in a method for controlling dump driving for a construction machine according to an embodiment of the present invention.
Figure 3:
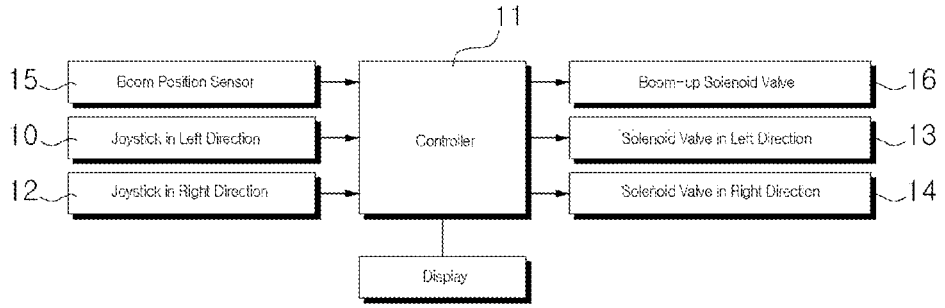
FIG. 3 is a schematic diagram illustrating the configuration of a controller in a method for controlling dump driving for a construction machine according to an embodiment of the present invention.

As illustrated in FIGS. 1 to 3, a method for controlling dump driving for a construction machine including a lower driving structure, an upper swing structure mounted on the lower driving structure to swing according to an operation of a swing joystick, a cab mounted on the upper swing structure, and an attachment including a boom fixed to a front end of the upper swing structure to be driven according to an operation of an attachment joystick according to an embodiment of the present invention includes a first step S100 of setting a semi-auto dumping mode (semi-auto dumping mode=on) according to an operation of an input device; a second step S200 and S300 of setting a swing direction of the upper swing structure for a dumping work and a boom-up dumping height; a third step S400 of determining the swing direction of the upper swing structure through determination of whether operation signal values, which are input to a controller to correspond to an operation amount in the case where the swing joystick is operated in left and right directions, are larger than predetermined values; a fourth step S500 of controlling a corresponding swing valve according to the operation signal value of the swing joystick in the swing direction determined in the third step S400 and driving boom-up according to the operation signal value obtained through the operation of the swing joystick; a fifth step S600 and S700 of stopping the boom-up driving when the boom-up height reaches a predetermined dumping height, and making the upper swing structure swing to a dumping position according to the operation signal value of the swing joystick; a sixth step S800 and S900 of driving the corresponding swing valve according to the operation signal value of the swing joystick so that the upper swing structure swings in an opposite direction to the swing direction of the upper swing structure determined in the third step S400; and a seventh step S1000 and S1100 of controlling the swing driving according to the operation signal value that is input in an opposite swing direction if the operation signal value of the swing joystick is not input in the swing direction determined in the sixth step S800 and S900, but is input in the opposite swing direction. In the seventh step S1000 and S1100, the boom-up and the swing driving in the swing direction determined by an operator in the second step S200 are cancelled.

In this case, a monitor or an operation button that is installed in the cab may be used as the input device in the first step S100.

The boom-up dumping height in the second step S200 and S300 may be set and changed through the monitor or the operation button that is installed in the cab.

The fourth step S500 may operate to receive feedback of a boom position and to perform boom-up to a predetermined dumping position even if the boom-up joystick for the boom-up driving is not operated in the fourth step S500.

If it is required that a boom cylinder for driving the attachment in order to execute a semi-auto dumping work is constantly positioned in a predetermined position, the boom cylinder position may be set and changed according to an operator's request, and may be maintained regardless of the operation of other attachments (an arm and a bucket).

Hereinafter, a use example of a method for controlling dump driving for a construction machine according to a preferred embodiment of the present invention will be described with reference to the accompanying drawings.

FIG. 1 is a flowchart illustrating a dumping work process through making an upper swing structure swing in a left direction in a method for controlling dump driving for a construction machine according to an embodiment of the present invention.

Referring to FIGS. 1 to 3, an operator sets a semi-auto dumping mode (semi-auto dumping mode=on) through an operation of an input device, such as a monitor or an operation button installed in a cab of an excavator. Through this, a working mode in which swing of the upper swing structure and boom-up can be simultaneously operated by an operation of a swing joystick is set (see S100).

In S200, it is determined whether the swing direction of the upper swing structure for a dumping work is set to a left direction or a right direction through an operation panel for setting the swing direction of the upper swing structure. If the upper swing structure is set to swing in the left direction (semi-auto swing direction=left), the processing proceeds to S300, whereas if the upper swing structure is set to swing in the right direction (semi-auto swing direction=right), the processing proceeds to S1200.

In S300, a boom-up height is set to a desired (target) dumping height $_{Htarget}$ (boom-up height=$H_{target}$).

Through this, setting of all modes for the semi-auto dumping work is completed.

In S400, if an operation signal value that is input to the controller 11 corresponding to an operation amount when a swing joystick 10 is operated by an operator is equal to or larger than a predetermined value A that is predetermined in the controller 11 (swing left joystick command≥A), and if an operation signal value that is input to the controller 11 corresponding to an operation amount when a swing joystick 12 in the right direction is operated is smaller than a predetermined value B (swing right joystick command<B), the processing proceeds to S500.

In S500, the operation signal value through the operation of the swing joystick 10 in the left direction is selected (swing left joystick command to valve=Ci), and thus opening of a swing valve is determined by the operation signal value of the swing joystick 10. That is, a solenoid valve 13 in the left direction is shifted by a control signal from the controller 11, and thus the swing of the upper swing structure is performed in the left direction.

If the operation signal value through the operation of the swing joystick 10 in the left direction is input to the controller 11 as described above, the control signal is not output from the controller 11 to the solenoid valve 14 in the right direction (swing right joystick command to valve=0).

At the same time, due to a preferential function of a boom-up solenoid valve 16 during the operation of the boom-up joystick, control signal pressure that is relatively higher than the control signal pressure in the case where the control signal pressure is input to the boom-up solenoid valve 16 through the operation of the swing joystick may be input to the boom-up solenoid valve 16 according to an operation amount of the boom-up joystick. In this case, in consideration of an operator's safety, an input of control signal pressure to the boom-up solenoid valve 16 may be set to be cut off even if the boom-up joystick is operated.

Through this, opening of the boom-up solenoid valve is determined by the operation signal value of the swing joystick 10 in the left direction. That is, the boom-up is driven by a control signal that is input from the controller 11 to the boom-up solenoid valve 16.

In S600, the boom-up through the driving of a boom cylinder and the swing of the upper swing structure through the driving of a swing motor are simultaneously preformed. In this case, it is determined whether the boom-up height reaches a desired dumping height (boom-up height≥$H_{target}$). If the boom-up height reaches the dumping height, the processing proceeds to S700, whereas if the boom-up height does not reach the dumping height, the processing proceeds to S500.

In S700, if a boom-up joystick operation signal is input to the controller 11, the control signal that is output from the controller 11 to the boom-up solenoid 16 is cut off (boom-up joystick command to valve=0), and the boom-up driving is not performed any further. Further, the operation signal of the swing joystick 12 in the right direction is cut off by the swing valve (swing right joystick command to valve=0).

In this case, the opening of the swing valve is determined by the operation signal value of the swing joystick 10 in the left direction (swing left joystick command to valve=Ei). That is, the upper swing structure swings in the left direction by the control signal input from the controller 11 to the solenoid valve 13 in the left direction.

As described above, the swing driving of the upper swing structure in the left direction and the boom-up driving are simultaneously performed by the operation signal of the swing joystick 10 in the left direction, and the boom-up height reaches the set dumping height. In this case, since the boom-up driving is stopped and the upper swing structure swings to the dumping position, excavated earth and sand can be loaded in the loading container of the dump truck.

In order to resume the digging work after loading the loading container with the excavated earth and sand, the bucket moves to the digging position through the swing driving of the upper swing structure and the boom-down driving. That is, in order to perform the digging work again after loading the loading container with the excavated earth and sand, the upper swing structure is driven in an opposite direction to the direction in which the earth and sand are loaded. This operation is realized through the sixth step S800 and S900.

In S800, an operation signal is input so as to make the upper swing structure swing in the opposite direction (i.e., right direction) to the swing direction (i.e., left direction) during the dumping if the operation signal value that is input to the controller 11 corresponding to an operation amount when the swing joystick 10 in the left direction is operated is smaller than the predetermined value A that is predetermined in the controller 11 (swing left joystick command<A) and the operation signal value that is input to the controller 11 corresponding to an operation amount when the swing joystick 12 in the right direction is operated is equal to or larger than the predetermined value B (swing right joystick command≥B), the processing proceeds to S900.

In S900, the operation signal value through the operation of the swing joystick 12 in the right direction is selected (swing right joystick command to valve=Fi), and thus opening of the swing valve is determined by the operation signal value of the swing joystick 12 in the right direction. That is, a solenoid valve 14 in the right direction is shifted by a control signal from the controller 11, and thus the swing of the upper swing structure is performed in the right direction.

In this case, if the operation signal value through the operation of the swing joystick 12 in the right direction is input to the controller 11, the control signal from the controller 11 cancels the signal of the solenoid valve 13 in the left direction (swing left joystick command to valve=0).

In S200, as the semi-auto swing direction is set to the left direction, the swing is performed simultaneously with the boom-up through the joystick input in the left swing direction. If the swing joystick is operated in the right direction that is opposite to the semi-auto swing direction, the control signal for the semi-auto swing and the boom-up is canceled, and thus the swing and the boom-up can be driven by two different joystick operations.

In S1000, if the operation signal value of the swing joystick and the operation signal value of the boom-up joystick are smaller than the predetermined values (i.e., if the swing joystick operation signal is not input), that is, if the operation signal value of the swing joystick 10 in the left direction is smaller than the predetermined value A (swing left joystick command<A) and the operation signal value of the swing joystick 12 in the right direction is smaller than the predetermined value B (swing right joystick command<B), the processing proceeds to S1100.

In S1100, if the operation signal value of the swing joystick 10 in the left direction is not input (swing left joystick command to valve=0), if the operation signal value of the swing joystick 12 in the right direction is not input (swing right joystick command to valve=0), or if the operation signal value of the boom-up joystick is not input (boom-up joystick command to valve=0), both the boom-up driving and the swing driving of the upper swing structure are kept in a stop state.

FIG. 2 is a flowchart illustrating a dumping work process through making an upper swing structure swing in a right direction in a method for controlling dump driving for a construction machine according to an embodiment of the present invention.

Referring to FIGS. 2 and 3, an operator sets a semi-auto dumping mode (semi-auto dumping mode=on) through an operation of an input device, such as a monitor or an operation button installed in a cab of an excavator (see S100A).

In S200A, it is determined whether the swing direction of the upper swing structure for a dumping work is set to a left direction or a right direction through an operation panel for setting the swing direction of the upper swing structure. If the upper swing structure is set to swing in the right direction (semi-auto swing direction=right), the processing proceeds to S300A, whereas if the upper swing structure is set to swing in the left direction (semi-auto swing direction=left), the processing proceeds to S1200A.

In S300A, a boom-up height is set to a desired (target) dumping height $H_{target}$ (boom-up height=$H_{target}$).

Through this, setting of all modes for the semi-auto dumping work is completed.

In S400A, if an operation signal value input to the controller 11 is equal to or larger than a predetermined value B (swing right joystick command≥B) through the operation of a swing joystick 12 in the right direction of the operator and if an operation signal value input to the controller 11 is smaller than a predetermined value A (swing left joystick command<A) through the operation of a swing joystick 10 in the left direction, the processing proceeds to S500A.

In S500A, the operation signal value through the operation of the swing joystick 12 in the right direction is selected (swing right joystick command to valve=Ci), and thus opening of a swing valve is determined by the operation signal value of the swing joystick 12 in the right direction. That is, a solenoid valve 14 in the right direction is shifted by a control signal from the controller 11, and thus the swing of the upper swing structure is performed in the right direction.

If the operation signal value through the operation of the swing joystick 12 in the right direction is input to the controller 11 as described above, the control signal is not output from the controller 11 to the solenoid valve 13 in the left direction (swing left joystick command to valve=0).

At the same time, due to a preferential function of a boom-up solenoid valve 16 during the operation of the boom-up joystick, control signal pressure that is relatively higher than the control signal pressure in the case where the control signal pressure is input to the boom-up solenoid valve 16 through the operation of the swing joystick may be input to the boom-up solenoid valve 16 according to an operation amount of the boom-up joystick. In this case, in consideration of an operator's safety, an input of control signal pressure to the boom-up solenoid valve 16 may be set to be cut off even if the boom-up joystick is operated. Through this, opening of the boom-up solenoid valve is determined by the operation signal value of the swing joystick 12 in the right direction. That is, the boom-up is driven by a control signal that is input from the controller 11 to the boom-up solenoid valve 16.

In S600A, the boom-up through the driving of a boom cylinder and the swing of the upper swing structure through the driving of a swing motor are simultaneously preformed. In this case, it is determined whether the boom-up height reaches a desired dumping height (boom-up height≥$H_{target}$). If the boom-up height reaches the dumping height, the processing proceeds to S700A, whereas if the boom-up height does not reach the dumping height, the processing proceeds to S500A.

In S700A, if a boom-up joystick operation signal is input to the controller 11, the control signal that is output from the controller 11 to the boom-up solenoid 16 is cut off (boom-up joystick command to valve=0), and the boom-up driving is not performed any further. Further, the operation signal of the swing joystick 10 in the left direction is cut off by the swing valve (swing left joystick command to valve=0).

In this case, the opening of the swing valve is determined by the operation signal value of the swing joystick 12 in the right direction (swing right joystick command to valve=Ei). That is, the upper swing structure swings in the right direction by the control signal input from the controller 11 to the solenoid valve 14 in the right direction.

As described above, the swing driving of the upper swing structure in the right direction and the boom-up driving are simultaneously performed by the operation signal of the swing joystick 12 in the right direction, and the boom-up height reaches the set dumping height. In this case, since the boom-up driving is stopped and the upper swing structure swings to the dumping position, excavated earth and sand can be loaded in the loading container of the dump truck.

In order to resume the digging work after loading the loading container with the excavated earth and sand, the bucket moves to the digging position through the swing driving of the upper swing structure and the boom-down driving. That is, in order to perform the digging work again after loading the loading container with the excavated earth and sand, the upper swing structure is driven in an opposite direction to the direction in which the earth and sand are loaded. This operation is realized through the sixth step S800A and S900A.

In S800A, an operation signal is input so as to make the upper swing structure swing in the opposite direction (i.e., left direction) to the swing direction (i.e., right direction) during the dumping. If the operation signal value of the swing joystick 12 in the right direction is smaller than the predetermined value B (swing right joystick command<B) and the operation signal value of the swing joystick 10 in the left direction is equal to or larger than the predetermined value A (swing left joystick command≥A), the processing proceeds to S900A.

In S900A, the operation signal value through the operation of the swing joystick 10 in the left direction is selected (swing left joystick command to valve=Fi), and thus opening of the swing valve is determined by the operation signal value of the swing joystick 10 in the left direction.

That is, a solenoid valve 13 in the left direction is shifted by a control signal from the controller 11, and thus the swing of the upper swing structure is performed in the left direction.

In this case, if the operation signal value through the operation of the swing joystick 10 in the left direction is input to the controller 11, the control signal from the controller 11 cancels the signal of the solenoid valve 14 in the right direction (swing right joystick command to valve=0).

In S200A, as the semi-auto swing direction is set to the right direction, the swing is performed simultaneously with the boom-up through the joystick input in the right swing direction. If the swing joystick is operated in the left direction that is opposite to the semi-auto swing direction, the control signal for the semi-auto swing and the boom-up is canceled, and thus the swing and the boom-up can be driven by two different joystick operations.

In S1000A, if the operation signal value of the swing joystick and the operation signal value of the boom-up joystick are smaller than the predetermined values (i.e., if the swing joystick operation signal is not input), that is, if the operation signal value of the swing joystick 12 in the right direction is smaller than the predetermined value B (swing right joystick command<B) and the operation signal value of the swing joystick 10 in the left direction is smaller than the predetermined value A (swing left joystick command<A), the processing proceeds to S1100A.

In S1100A, if the operation signal value of the swing joystick 12 in the right direction is not input (swing right joystick command to valve=0), if the operation signal value of the swing joystick 10 in the left direction is not input (swing left joystick command to valve=0), or if the operation signal value of the boom-up joystick is not input (boom-up joystick command to valve=0), both the boom-up driving and the swing driving of the upper swing structure are kept in a stop state.

INDUSTRIAL APPLICABILITY

As apparent from the above description, according to the present invention having the above-described configuration, the operational convenience can be provided to the operator through the simultaneous operation of boom-up and swing according to the operation of the swing joystick during the dumping work. Also, the operator's fatigue can be reduced through non-requiring of the high concentration during the joystick operation. Further, the operator can accurately set the desired boom-up height during the dumping work and the swing can easily reach the dumping position only through the operation of the swing joystick after the setting.

The invention claimed is:

1. A method for controlling dump driving for a construction machine including a lower driving structure, an upper swing structure mounted on the lower driving structure to swing according to an operation of a swing joystick, a cab mounted on the upper swing structure, and an attachment including a boom fixed to a front end of the upper swing structure to be driven according to an operation of an attachment joystick, the method comprising:

a first step of setting a semi-auto dumping mode according to an operation of an input device;

a second step of setting a swing direction of the upper swing structure for a dumping work and a boom-up dumping height;

a third step of determining the swing direction of the upper swing structure through determination of whether operation signal values, which are input to a controller to correspond to an operation amount in the case where the swing joystick is operated in left and right directions, are larger than predetermined values;

a fourth step of controlling a corresponding swing valve according to the operation signal value of the swing joystick in the swing direction determined in the third step and driving boom-up according to the operation signal value obtained through the operation of the swing joystick;

a fifth step of stopping the boom-up driving when the boom-up height reaches a predetermined dumping height, and making the upper swing structure swing to a dumping position according to the operation signal value of the swing joystick;

a sixth step of driving the corresponding swing valve according to the operation signal value of the swing joystick so that the upper swing structure swings in an opposite direction to the swing direction of the upper swing structure; and a seventh step of stopping the boom-up and the swing driving if the operation signal value of the swing joystick is not input.

2. The method for controlling dump driving according to claim 1, wherein a monitor that is installed in the cab is used as the input device in the first step.

3. The method for controlling dump driving according to claim 1, wherein the boom-up dumping height in the second step is set and changed through a monitor that is installed in the cab.

4. The method for controlling dump driving according to claim 1, wherein the boom-up dumping height in the second step is set and changed through an operation button that is installed in the cab.

5. The method for controlling dump driving according to claim 1, wherein an operation button that is installed in the cab is used as the input device in the first step.

6. The method for controlling dump driving according to claim 1, wherein the fourth step operates to receive feedback of a boom position and to perform boom-up to a predetermined dumping position even if the boom-up joystick for the boom-up driving is not operated in the fourth step.

7. The method for controlling dump driving according to claim 1, wherein if it is required that a boom cylinder for driving the attachment in order to execute a semi-auto dumping work is constantly positioned in a predetermined position, the boom cylinder position is set and changed according to an operator's request, and is maintained regardless of the operation of other attachments.

8. The method for controlling dump driving according to claim 1, wherein if a semi-auto dumping mode is set and the swing and the boom-up are simultaneously operated through the operation of the swing joystick in a semi-auto swing direction, a boom-up preferential function is displayed during the operation of the boom-up joystick, and relatively higher control signal pressure than control signal pressure that is input to a boom-up solenoid valve through the operation of the swing joystick is input according to an operation amount of the boom-up joystick.

9. The method for controlling dump driving according to claim 1, wherein if a semi-auto dumping mode is set and the swing and the boom-up are simultaneously operated through the operation of the swing joystick in a semi-auto swing direction, an input of control signal pressure to a boom-up solenoid valve is cut off even if the boom-up joystick is operated.

10. A method for simultaneously controlling a construction machine upper swing structure and a boom fixed to the upper swing structure, the upper swing structure mounted to a lower driving structure, the method comprising:

activating a working mode in which swing of the upper swing structure and raising of the boom is simultaneously operated by operation of the swing joystick;

setting a left swing mode or a right swing mode of the upper swing structure;

setting a target dumping height of the boom;

wherein in the right swing mode:

when the swing joystick is moved right, the upper swing structure swings right and the boom simultaneously rises gradually towards and to the target dumping height;

when the swing joystick is moved left, the upper swing structure swings left and the boom does not move;

wherein in the left swing mode:

when the swing joystick is moved left, the upper swing structure swings left and the boom simultaneously rises gradually towards and to the target dumping height; and when the swing joystick is moved right, the upper swing structure swings right and the boom does not move.

* * * * *